US005988119A

United States Patent [19]

Trublowski et al.

[11] Patent Number: 5,988,119

[45] Date of Patent: Nov. 23, 1999

[54] ELECTRONIC CONTROL MODULE ASSEMBLY USING THROTTLE BODY AIR FOR COOLING AND METHOD THEREOF

[75] Inventors: John Trublowski, Troy; Mitchell Anthony DePerno, Royal Oak; Marc Bronzetti, Berkley; Bertrand Mohr, Ann Arbor, all of Mich.

[73] Assignee: Ford Motor Company, Dearborn, Mich.

[21] Appl. No.: 09/128,005

[22] Filed: Aug. 3, 1998

[51] Int. Cl.[6] ..... F01P 1/06

[52] U.S. Cl. ..... 123/41.31; 123/556; 123/585; 123/647; 361/690; 361/691

[58] Field of Search ..... 123/41.31, 547, 123/556, 585, 647; 361/690–699

[56] References Cited

U.S. PATENT DOCUMENTS

| | | | |
|---|---|---|---|
| 4,319,188 | 3/1982 | Ito et al. | 324/173 |
| 4,557,225 | 12/1985 | Sagues et al. | 123/41.31 |
| 4,766,869 | 8/1988 | De Concini et al. | 123/647 |
| 5,012,780 | 5/1991 | Bugamelli . | |
| 5,094,212 | 3/1992 | Kawaguchi et al. . | |
| 5,207,186 | 5/1993 | Okita | 123/41.31 |
| 5,243,279 | 9/1993 | Bajat et al. . | |
| 5,450,832 | 9/1995 | Graf . | |
| 5,861,747 | 1/1999 | Kubinski | 324/207.21 |

*Primary Examiner*—Willis R. Wolfe
*Assistant Examiner*—Brian Hairston
*Attorney, Agent, or Firm*—Leslie C. Hodges

[57] ABSTRACT

There is disclosed herein an electronic control module assembly 30 for use in an internal combustion engine, wherein the engine includes an intake manifold 10 with N air inlet port(s) 14 and a throttle body 20 with N air outlet port(s) 24 where N=(1 or 2). One embodiment of the assembly 30 comprises: (a) a housing 32 having opposed upper and lower mounting surfaces 34/36 and an outer surface 38 about the housing, and N bore(s) 42 through the housing, wherein each bore has an upstream port 44 defined in the upper mounting surface 34 and a downstream port 54 defined in the lower mounting surface 36; (b) an electronic control module 60 for controlling one or more sub-systems of the engine; and (c) means 70 for attaching the electronic control module 60 to the outer surface 38 of the housing 32.

17 Claims, 4 Drawing Sheets

ELECTRONIC CONTROL MODULE ASSEMBLY USING THROTTLE BODY AIR FOR COOLING AND METHOD THEREOF

BACKGROUND OF THE INVENTION

1. Field of the Invention

The present invention relates generally to an internal combustion engine having a throttle body and an electronic control module, and more particularly to an assembly for using air flow through a throttle body to cool an engine electronic control module.

2. Disclosure Information

FIG. 1 illustrates a typical internal combustion engine having a throttle body 20 mounted atop an intake manifold 10. The throttle body 20 may have one or two bores 22 formed therein, each of which extends completely through the throttle body and terminates in an outlet port 24 defined in a bottom surface 26 of the throttle body. The intake manifold 10 has the same number N of bores therethrough as the throttle body (i.e., N=1 or 2), wherein each manifold bore 12 extends completely through the manifold and originates from an inlet port 14 defined in a top surface 16 of the manifold. The top and bottom surfaces 16/26 and the inlet and outlet ports 14/24 are configured such that the throttle body may be sealably and removably fastened atop the manifold such that the respective inlet and outlet ports 14/24 are placed in sealed communication with each other, as illustrated in FIG. 2. Optional sealing means (not shown), such as one or more gaskets, may be sandwiched between the manifold and throttle body. When sealably fastened together as illustrated in FIG. 2, air may be inducted from the atmosphere through the throttle body bore(s), then into the manifold bore(s), and thence into the engine.

FIGS. 1–2 illustrate an engine having N=2 bores through each of the manifold and throttle body. FIG. 3 shows an alternative configuration having only N=1 bore through the manifold and throttle body. In the former case (FIGS. 1–2), the larger of the two bores 12/22 is the main bore 12*m*/22*m* and the smaller is the idle speed bypass bore 12*b*/22*b*; in the latter case (FIG. 3), a single through-bore 12/22 is provided, with a non-through-bore idle speed bypass channel 28 being defined within the throttle body only. (It should be noted that as used herein, the word "bore" means any cavity or channel within or through the intake manifold or throttle body, and is not limited to the conventional meaning of the word which otherwise refers typically to only straight, circular-cylindrical through-holes.)

Most modern internal combustion engines, such as those found in current-model automobiles, also include one or more electronic control modules (not shown) which process data from various sensors and provide control signals to various engine sub-system and components in order to maintain optimum engine performance. For example, the Powertrain Control Module (a/k/a Electronic Engine Control Module) may receive data from the throttle position sensor, mass air flow sensor, etc. and send control signals to the throttle plate actuator, idle speed bypass solenoid valve, etc., in order to maintain the engine speed at predetermined levels. In automobiles, these control modules are typically mounted on the firewall or at other sites remote from the sensors, control elements, and engine components they are associated therewith. However, the engine environment where such modules are located is typically very hot, which is problematic for the electronic components within the aforementioned modules.

It would be desirable, therefore, to find an approach which enhances the cooling of such modules, and which may also provide increased functionality thereby.

SUMMARY OF THE INVENTION

The present invention provides the aforementioned desired approach by providing a specially designed electronic control module assembly for use in an internal combustion engine, wherein the engine includes an intake manifold with N air inlet port(s) and a throttle body with N air outlet port(s) where N=(1 or 2). One embodiment of the assembly comprises: (a) a housing having opposed upper and lower mounting surfaces and an outer surface about the housing, and N bore(s) through the housing, wherein each bore has an upstream port defined in the upper mounting surface and a downstream port defined in the lower mounting surface; (b) an electronic control module for controlling one or more sub-systems of the engine; and (c) means for attaching the electronic control module to the outer surface of the housing. This assembly may be interposed between the throttle body and intake manifold for cooling the electronic control module attached thereto.

It is an object and advantage that the present invention may be used in an internal combustion engine to cool the electronic components within an electronic control module using the air passing through the idle speed bypass bore or the main bore of the engine throttle body.

Another advantage is that the present invention may position an electronic control module closer to the engine system(s) it controls than is the case with previous approaches.

Yet another advantage is that the present invention may be interposed between an existing throttle body and intake manifold without modification to either component.

These and other advantages, features and objects of the invention will become apparent from the drawings, detailed description and claims which follow.

DETAILED DESCRIPTION OF THE PREFERRED EMBODIMENTS

Figure 1:
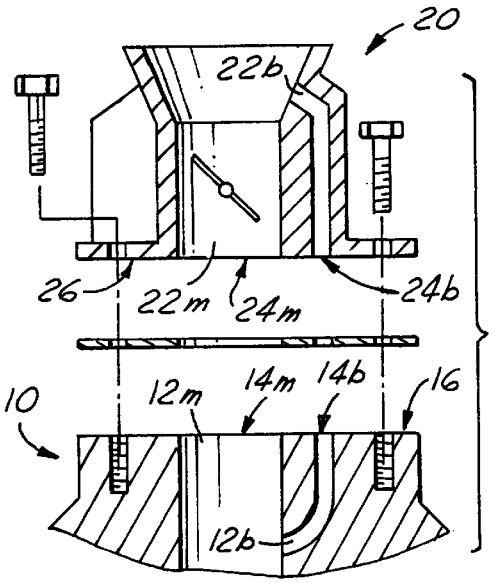
(PRIOR ART) FIG. 1
FIGS. 1–2 are sectional-side views of a double-through-bored (N=2) intake manifold and throttle body before and after assembly, respectively, according to the prior art.
Figure 2:
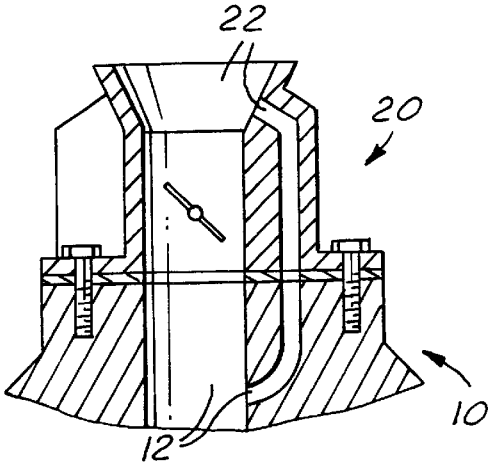
(PRIOR ART) FIG. 2
Figure 3:
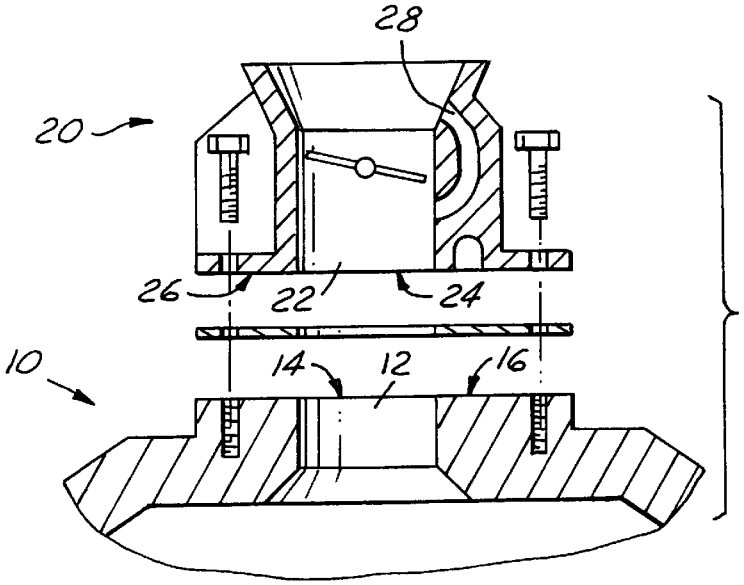
(PRIOR ART) FIG. 3
FIG. 3 is a sectional-side view of a single-through-bored (N=1) intake manifold and throttle body before assembly, according to the prior art.
Figure 4:
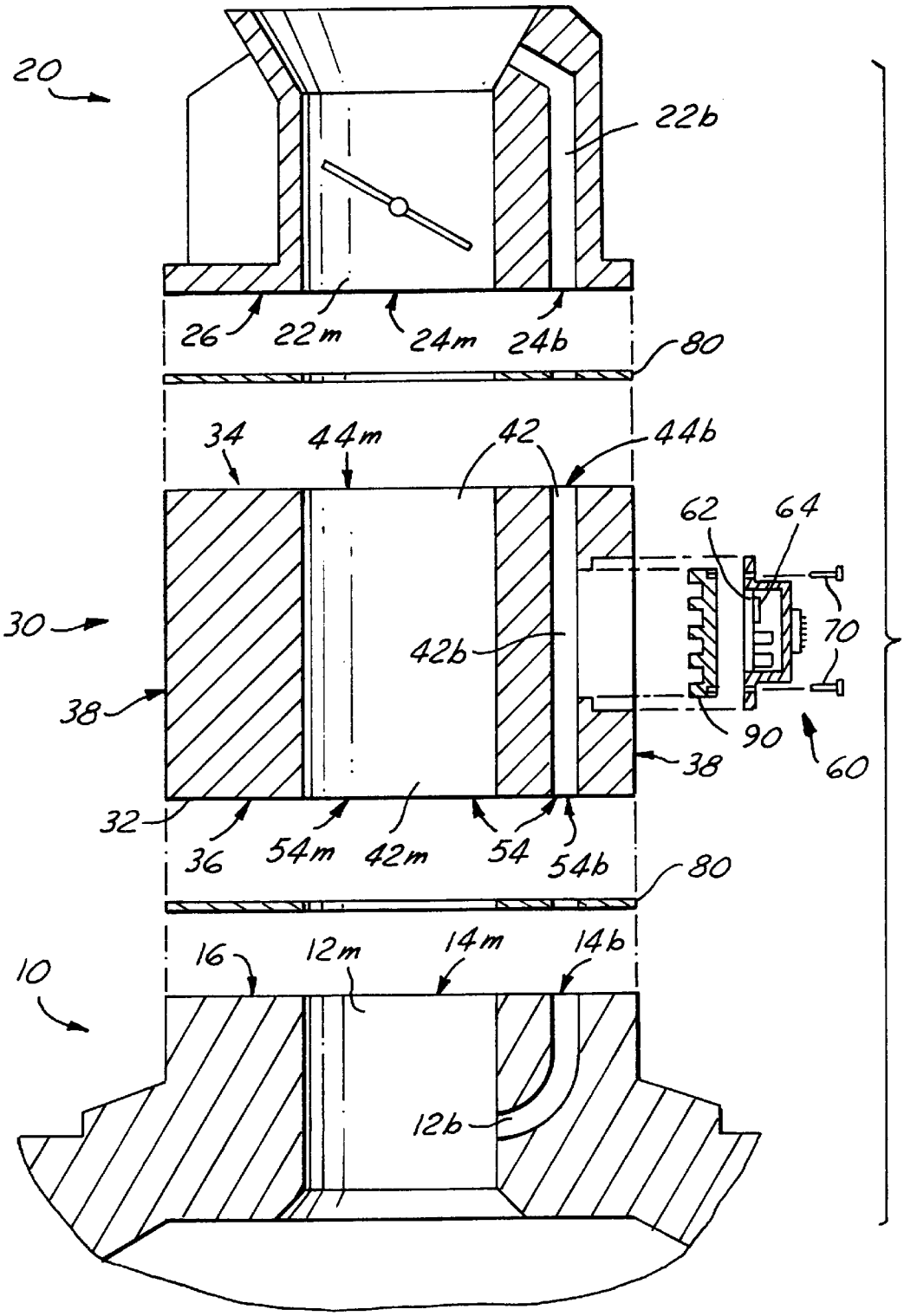
FIGS. 4–5 are sectional-side and perspective views, respectively, of an electronic control module assembly according to a first embodiment of the present invention.
Figure 5:
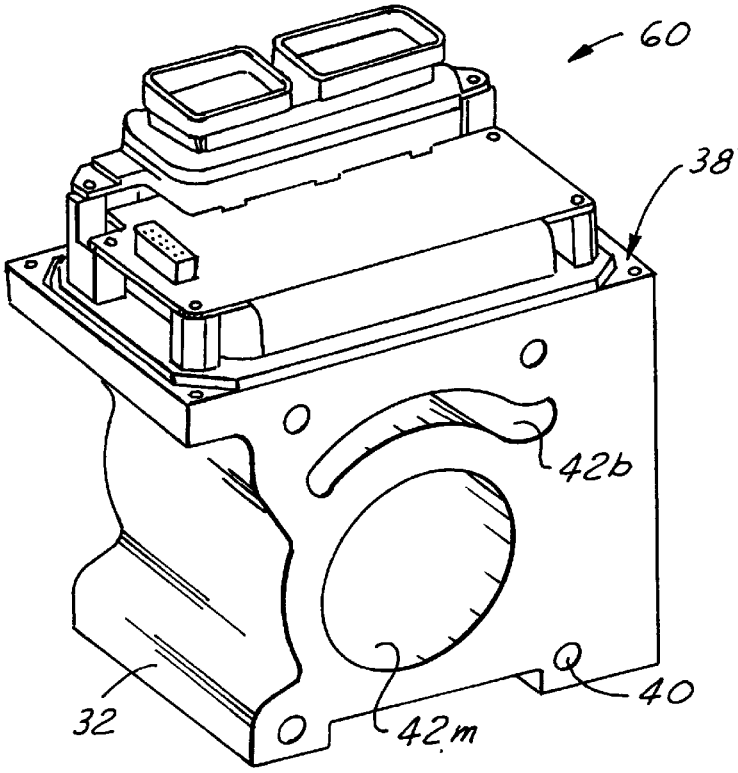
Figure 6:
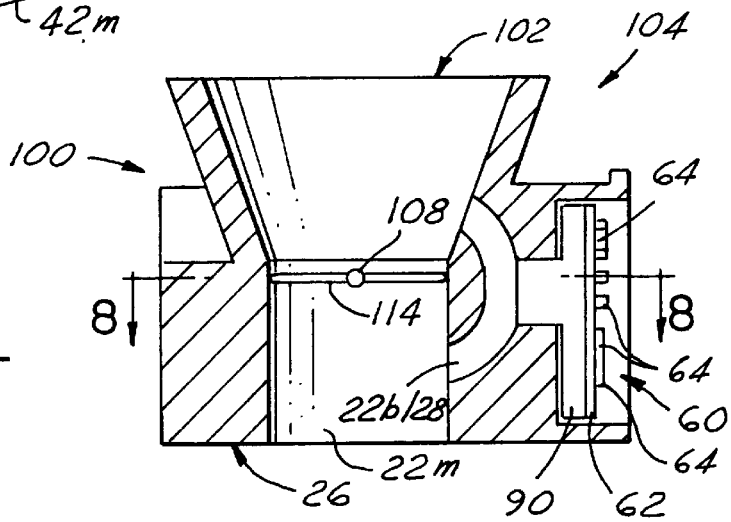
FIGS. 6–9 are sectional-side, side, sectional-top, and perspective views, respectively, of an integrated throttle body assembly according to a second embodiment of the present invention.

Referring now to the drawings, FIGS. 4–5 show an electronic control module assembly 30 for use in an internal combustion engine according to a first embodiment of the present invention. The engine includes an intake manifold 10 with N air inlet port(s) 14 and a throttle body 20 with N air outlet port(s) 24, where N=(1 or 2). The assembly 30 comprises: (A) a housing 32 having opposed upper and lower mounting surfaces 34/36 and an outer surface 38 about the housing, and N bore(s) 42 through the housing, wherein each bore has an upstream port 44 defined in the upper mounting surface 34 and a downstream port 54 defined in the lower mounting surface 36; (B) an electronic control module 60 for controlling one or more sub-systems of the engine; and (C) means 70 for attaching the electronic control module 60 to the outer surface 38 of the housing 32.

To assist the reader in understanding the present invention, all reference numbers used herein are summarized in the table below, along with the elements they represent:

10=Intake manifold
12=Bore(s) within intake manifold
12*m*=Main bore of intake manifold
12*b*=Bypass bore of intake manifold
14=Inlet port(s) of intake manifold
14*m*=Main bore inlet port
14*b*=Bypass bore inlet port
16=Top surface of intake manifold
20=Throttle body
22=Bore(s) within throttle body
22*m*=Main bore of throttle body
22*b*=Bypass bore of throttle body
24=Outlet port(s) of throttle body
24*m*=Main bore outlet port
24*b*=Bypass bore outlet port
26=Bottom surface of throttle body
28=Internal idle speed bypass channel (N=1)
30=Electronic control module assembly (first embodiment)
32=Housing
34=Upper mounting surface
36=Lower mounting surface
38=Outer surface
40=Mounting holes in housing
42=Bore(s) through housing
42*m*=Main bore through housing
42*b*=Bypass bore through housing
44=Upstream port(s) of housing
44*m*=Main bore upstream port
44*b*=Bypass bore upstream port
54=Downstream port(s) of housing
54*m*=Main bore downstream port
54*b*=Bypass bore downstream port
60=Electronic control module
62=Circuit board portion of module
64=Electronic component
70=Means for attaching the module to the housing
80=Sealing means (e.g., gasket)
90=Heat sink between module and bore(s)
100=integrated throttle body assembly (second embodiment)
102=Upper air intake port of integrated throttle body
104=Outer surface of integrated throttle body
106=Giant magnetoresistor array
108=Throttle plate shaft
110=Magnet on throttle plate shaft
114=Throttle plate
N=Number of bores/ports (N=1 or 2)

The housing 32 may be made of molded plastic or die-cast metal, with the opposed upper and lower mounting surfaces 34/36 generally conforming with the bottom surface 26 of the throttle body and the top surface 16 of the intake manifold, respectively. Typically, the upper and lower surfaces 34/36 are generally flat and parallel with each other, with the outer surface 38 being defined about the housing 32 between the upper and lower surfaces 34/36. As illustrated in FIG. 5, the general shape of the housing 32 may be that of a prism (e.g., a quadrangular prism or parallelepiped), or the housing 32 may be generally cylindrical or otherwise shaped as desired.

Defined within the housing are N through-bores 42, where N is either 1 or 2; this number N is selected to match the number of bores/ports present in the particular intake manifold/throttle body con figuration with which the assembly 30 is to be used. Each bore 42 has an upstream port 44 defined in the upper mounting surface 34 and a downstream port 54 defined in the lower mounting surface 36, with each upstream and downstream port 44/54 being sized and positioned in generally matched relation with a respective outlet and inlet port 24/14, respectively. In FIGS. 4–5, N=2, with the main bore 42*m* and idle speed bypass bore 42*b* being generally straight and oriented generally orthogonal to the upper and lower mounting surfaces 34/36; the configuration where N=1 is not shown, but is similar to that for N=2 but without the bypass bore 42*b*. The bore(s) 42 may be formed by lost core molding or similar methods (as is often the case with throttle bodies); however, because each bore 42 is preferably generally straight (i.e., has a substantially constant cross-section along the length of each bore), it may be most practical to utilize drafted core pins in the molding die, thereby producing bore(s) 42 in the finished part 32 with a slight draft angle along each bore. Of course, other methods of producing the housing and bore shapes are also possible, such as milling, drilling, boring, lamination, and the like.

The housing 32 may further include means for sealably and removably attaching the housing/assembly to the throttle body 20 and intake manifold 10. This may include providing holes 40 through the housing as shown in FIG. 5, through which threaded fasteners may be inserted. Sealing means 80, such as gaskets made of silicone, cork, or other suitable gasket materials, may also be provided for sealing the assembled throttle body/assembly/manifold 20/30/10 against air leaks, as illustrated in FIG. 4. Such sealing means 80 may be provided as separate pieces, or may be made integral with the housing 32, but in either case should be disposed at least about each upstream and downstream port 44/54.

The assembly 30 further includes an electronic control module 60 for controlling one or more sub-systems of the engine. For example, this module 60 may comprise a Powertrain Control Module, Electronic Throttle Control Module, and/or any other electronic module used by the engine to control any feature or characteristic thereof. The module typically includes a plurality of electronic components on a circuit board, with the board housed within a metal/plastic housing; one or more male/female electrical connectors (e.g., plugs, sockets, edge cards, pins) are also typically connected to or made integral with the circuit board and are disposed within the housing so as to provide electrical connectivity between the components/board and one or more external wire harness connectors. The module 60 may additionally include one or more heat sinks, heat spreaders, or the like which are in direct or indirect thermal contact with the circuit board and/or the electronic devices, and which have a surface thereof exposed through the module housing for thermal conduction (to an engine structure to which the exposed surface may be attached) or for thermal convection (to the atmosphere, an air stream within/adjacent the engine compartment, or the air stream(s) within the throttle bodies). In the simplest application, an already existing control module 60 may be removed from its original mounting site (e.g., a firewall or other engine structure) and mounted on the housing outer surface 38. Or, the module 60 may be redesigned with the present invention in mind, and may involve such modifications as eliminating or redesigning the module housing, eliminating or redesigning the heat spreader/heat sinks, etc., and then attached to the assembly housing outer surface 38.

The assembly 30 further includes means 70 for attaching the electronic control module 60 to the outer surface 38 of the housing, such as threaded fasteners, clips, snap-down clamps, plug-and-socket or other male/female connectors and arrangements, spring-loaded latches and slides, retainers, tab-and-slot fasteners, interference fit features, adhesives, and the like. The means 70 for attachment may be essentially permanent (e.g., epoxy adhesive), or may facilitate removable attachment (e.g., threaded fasteners). Because it may be desirable to remove the module 60 at some point after attachment to the housing 32 (e.g., for troubleshooting, repair, or upgrading), it is preferable that the means 70 be for removably attaching the module 60 to the housing 32. For example, the means 70 may include one or more threaded fasteners which screw through the module and into the housing outer surface 38 (where mating female threaded holes may be provided). The outer surface 38 where the module 60 is attached may be generally flat as in FIGS. 4–5, or may have a recess defined thereat into which the module 60 may be inserted.

The assembly 30 has the advantage that it may be utilized in any internal combustion engine having a throttle body and intake manifold. To use the assembly 30: (1) the throttle body 20 is unfastened from the intake manifold 10, (2) the assembly 30 is placed atop the manifold 10 with the respective downstream port(s) 54 and inlet port(s) 14 aligned, (3) the throttle body 20 is placed atop the assembly 30 with the respective upstream port(s) 44 and outlet port(s) 24 aligned, and (4) the throttle body/assembly/intake manifold 20/30/10 are fastened together, such as by using threaded fasteners or the like. Then, (5) the electronic control module 60 may be fastened to the housing outer surface 38 if not already provided thereon. The assembly 30 of the present invention may be utilized without modification to any previously existing parts, except that the original means for fastening the throttle body to the intake manifold may require slight modification (e.g., the threaded fasteners used to fasten the throttle body/assembly/manifold 20/30/10 may need to be longer than those used to fasten together only the throttle body/manifold 20/10).

The present invention 30 takes advantage of the fact that during operation of the engine, air is continuously flowing through the throttle body and manifold, whether through the idle speed bypass bore 22*b*/12*b* (for N=2) or internal bypass channel 28 (for N=1) during engine idling, or through the main bore 22*m*/12*m* (for N=1 or 2) during all other non-idling conditions. (During non-idling conditions, there is also a small amount of air flow through the bypass bore/channel, but most of the air flow during non-idling is through the main bore.) This air flow is also relatively cool, since it is inducted directly from the outside atmosphere and at this point is still upstream of the engine proper. With the assembly 30 positioned as shown, the continuous, cool air flow therethrough keeps the housing 32 relatively cool as well, making it an ideal place for mounting electronic components/modules 60. For configurations requiring two bores 42*m*/42*b* (i.e., N=2), it is preferable that the module 60 be mounted adjacent the bypass bore 42*b*; here, during non-idling conditions the housing 32 is cooled by air flow through the main bore 42*m*, and during idling the housing is cooled by air flow through the bypass bore 42*b*, thus making the outer surface 38 adjacent the bypass bore 42*b* the coolest position on the housing outer surface 38.

If the housing 32 is made of metal or some other thermally conductive material, the module 60 may simply be fastened onto the outer surface 38 preferably adjacent any bypass bore 42*b*. However, if the housing 32 is made of plastic or some other less thermally conductive material, it may be desirable to provide a heat sink 90 disposed within the housing 32 between the module 60 and the bore(s) 42, as illustrated in FIG. 4. The heat sink 90 should have a first end in thermal contact with the module/electronics 60 and a second end exposed to (or extending into) the interior of the bore(s) 42. In this arrangement, the heat sink 90 may conduct heat away from the module/electronics 60 and dissipate it by convection into the air stream present in the bore(s) 42. For N=1 configurations, the heat sink should be exposed to the interior of the single bore 42; for N=2 arrangements, the heat sink is preferably exposed to the interior of at least the bypass bore 42*b*, but may also be exposed to the interior of the main bore 42*m* as well. The heat sink 90 should be made of aluminum, copper, or some other highly conductive material, and may be placed in the housing 32 by insert-molding or through a post-molding operation. Alternatively, the heat sink 90 may be made part of the electronic control module 60, such that when the module 60 is mounted onto the housing outer surface 38, the heat sink 90 extends through an opening molded into the housing such that the heat sink 90 is exposed to and/or extends into the interior of the bore(s) 42.

A second embodiment of the present invention is shown in FIGS. 6–9. In this embodiment, the electronic control module 60 is mounted directly to the throttle body 20, rather than to a separate housing 32 interposed between the throttle body and manifold. This embodiment represents an integrated throttle body assembly 100 for use in an internal combustion engine, comprising: (A) a throttle body 20 having an upper air intake port 102, a lower mounting surface 26 for mounting atop an intake manifold 10, an outer surface 104 about the throttle body between the upper port 102 and lower surface 26, and N bore(s) 22 through the throttle body communicating the upper air intake port 102 with the lower mounting surface 26, where N=1 or 2; (B) an electronic control module 60 for controlling one or more sub-systems of the engine; and (C) means 70 for attaching the electronic control module 60 to the outer surface 104 of the throttle body.

Like the first embodiment 30, the present second embodiment 100 takes advantage of the same continuous, cool air flow through the throttle body/manifold for cooling an electronic control module 60. As with the first embodiment 30, the throttle body assembly 100 may include a heat sink 90 therein when the throttle body is made of molded plastic. The control module 60 may be removed from its original mounting site (e.g., a firewall or other engine structure) and mounted essentially as-is onto the throttle body outer surface 104, or, more preferably, it may be redesigned and modified with the present embodiment in mind.

Figure 7:
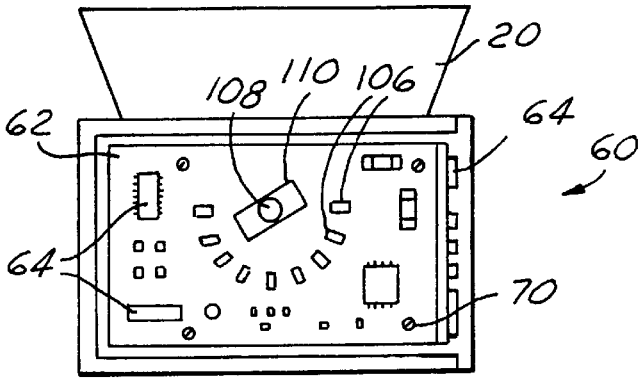
Figure 8:
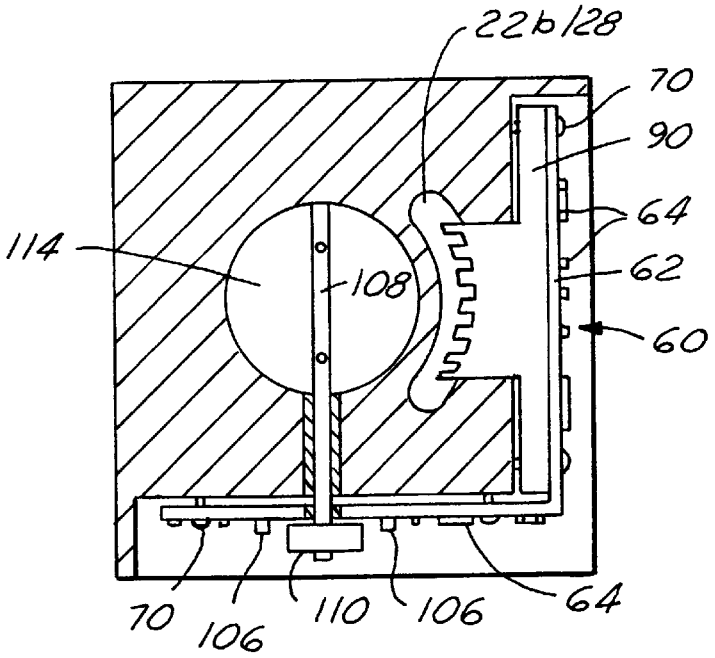
Figure 9:
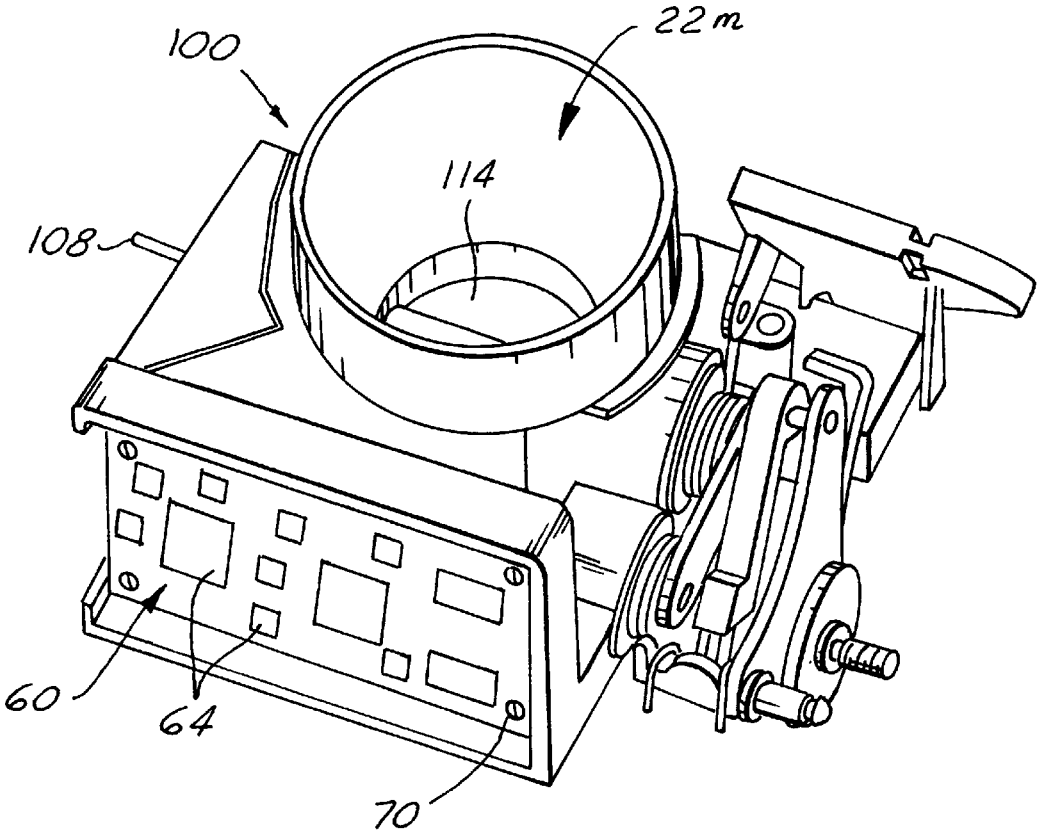

One such modification of the electronic control module 60 is illustrated in FIGS. 7–9. Here, the circuit board portion 62 of the module has been redesigned so as to wrap around a corner of the throttle body and onto the two adjacent faces thereof, thereby providing more surface area onto which the module 60 may be attached than if the typical flat circuit board were used.

Another modification is that one or more previously separate sensors and/or their associated electronics or control modules may be incorporated into a single throttle body-mounted module 60. For example, the Throttle Position Sensor (TPS) and its electronics module may be combined with the Powertrain Control Module (PCM) into a single module 60. As illustrated in FIG. 7, a generally semi-circular array of Giant Magnetoresistors (GMRs) 106 may be placed on the module circuit board 62 about the throttle plate shaft 108 and a suitable magnet 110 affixed to the shaft adjacent the GMRs. In this arrangement, the GMR array 106 may be used to sense the angular position of the magnetic flux plane created by the magnet, and thus the angular position of the throttle plate shaft itself. Other sensors, controllers, actuators, and/or their associated electronics/modules (e.g., the Mass Air Flow (MAF) sensor, the electronic throttle controller, etc.) may also be incorporated into the throttle body-mounted module 60.

This integration of various electronic components, modules, sensors, and the like (e.g., PCM, TPS, MAF, etc.) is advantageous in that it reduces the number of overall parts required, reduces the amount of labor needed to assemble the parts, and improves reliability; this is achieved by consolidating common structures/functions and eliminating redundancies. Four specific examples of this are: (1) using a single circuit board on which two or more previously separate sensors/modules may be consolidated, (2) using a single housing or cover to protect the consolidated components rather than the multiple housings/covers previously required, (3) reducing the number of fasteners needed because of consolidation, and (4) utilizing circuit traces on the circuit board to interconnect the consolidated features instead of the multiple, less reliable electromechanical/wire harness connectors previously required. Together, these and other features of the present invention provide an integrated throttle body assembly 100 which is simpler and less expensive than prior art approaches, and which provides the further advantage that the electronics module 60 carried thereon may be cooled by the air flow passing through the assembly 100.

Various other modifications to the present invention may occur to those skilled in the art to which the present invention pertains. For example, the module 60 may comprise fewer or different elements than described above; for example, the module might comprise only a circuit board 62 with electronic components 64 and one or more connectors thereon, with no heat sink 90 or module housing provided. If the throttle body is made of molded plastic, the module 60 may comprise circuits/traces directly plated onto the plastic throttle body, or circuits/traces in-molded therein. Also, in some of the drawings, the electronics module 60 is shown exposed without a covering thereover; this is done for illustration purposes only, and in actual application the module would normally have a removable cover thereover or housing therearound to protect the electronics from heat, impact, engine fluids and gases, etc. Additionally, the array 106 of GMRs may be arranged in a layout other than semi-circular; for example, the array 106 may be a generally circular arc spanning between 180 and 360 degrees, or it may comprise two or more non-contiguous generally circular arcs measuring less than 180 degrees each, and so forth. Furthermore, it should be noted that the first and second embodiments share many of the same advantages and benefits, although not all such advantages and benefits are singly and separately listed above for each embodiment. Also, it should be noted that not all of the drawings show the throttle linkages, sensors, bypass solenoid valve, and other supporting structure common to most throttle bodies; these elements have been omitted merely for clarity. Moreover, the use of the word "module" herein in connection with an engine unction, as in "Throttle Position Sensor module" for example, refers at least to the electronic components 64 (i.e., ICs, capacitors, resistors, transistors, and the like) responsible for controlling/effecting that function, and optionally to the housing, fasteners, circuit board substrate, connectors, potting material, shielding material, sealants, adhesives, etc. associated with the electronic components. Other modifications not explicitly mentioned herein are also possible and within the scope of the present invention. It is the following claims, including all equivalents, which define the scope of the present invention.

What is claimed is:

1. An electronic control module assembly for use in an internal combustion engine, wherein the engine includes an intake manifold with two air inlet ports and a throttle body with two air outlet ports, the assembly comprising:

(a) a housing having (i) opposed upper and lower mounting surfaces and an outer surface about said housing between said upper and lower mounting surfaces, and (ii) a main bore and an idle speed bypass bore through said housing, wherein each bore has an upstream port defined in said upper mounting surface and a downstream port defined in said lower mounting surface, each upstream and downstream port being sized and positioned in generally matched relation with a respective outlet and inlet port, respectively; and (b) an electronic control module for controlling one or more sub-systems of the engine, wherein said electronic control module is mounted on said outer surface of said housing generally adjacent said idle speed bypass bore.

2. An electronic control module assembly according to claim 1, wherein said housing is made of die cast metal or molded plastic.

3. An electronic control module assembly according to claim 1, wherein each bore is substantially straight.

4. An electronic control module assembly according to claim 1, wherein said upper and lower mounting surfaces are generally parallel with each other.

5. An electronic control module assembly according to claim 1, wherein said electronic control module comprises at least one of a powertrain control module, a throttle position sensor, a throttle position sensor module, a mass air flow sensor, and a mass air flow sensor module.

6. An electronic control module assembly according to claim 1, wherein said means for attaching comprises at least one of a threaded fastener, a spring-loaded fastener, a tab-and-slot fastener, and a thermally conductive adhesive.

7. An electronic control module assembly according to claim 1, further comprising sealing means disposed about each upstream and downstream port.

8. An electronic control module assembly according to claim 1, further comprising a plurality of generally straight mounting holes through said housing through which fasteners may be inserted for sealably and removably fastening said housing between the throttle body and the intake manifold.

9. An electronic control module assembly according to claim 1 wherein said housing is made of plastic, said assembly further comprising a thermally conductive heat sink disposed within said housing, said heat sink having a first end in thermal contact with said module and having a second end exposed to an interior of at least one of said N bore(s).

10. An electronic control module assembly for use in an internal combustion engine, wherein the engine includes an intake manifold with two air inlet ports and a throttle body with two air outlet ports, the assembly comprising:

(a) a housing having (i) opposed upper and lower mounting surfaces and an outer surface about said housing between said upper and lower mounting surfaces, and (ii) a substantially straight main bore and a substantially straight idle seed bypass bore through said housing, wherein each bore has an upstream port defined in said upper mounting surface and a downstream port defined in said lower mounting surface, each upstream and downstream port being sized and positioned in generally matched relation with a respective outlet and inlet port, respectively; and (b) an electronic control module for controlling one or more sub-systems of the engine, said control module being removably mounted on said outer surface of said housing generally adjacent said idle speed bypass bore.

11. An electronic control module assembly according to claim 10, wherein said housing is made of die cast metal or molded plastic.

12. An electronic control module assembly according to claim 10, wherein said housing is made of plastic, said assembly further comprising a thermally conductive heat sink disposed within said housing, said heat sink having a first end in thermal contact with said module and having a second end exposed to an interior of at least one of said N bore(s).

13. An integrated throttle body assembly for use in an internal combustion engine, comprising:

(a) a throttle body having an upper air intake port, a lower mounting surface for mounting atop an intake manifold, an outer surface about said throttle body between said upper port and said lower surface, and a main bore and an idle speed bypass bore through said throttle body communicating said upper air intake port with said lower mounting surface; and (b) an electronic control module for controlling one or more sub-systems of the engine, said control module being removably attached to said outer surface of said throttle body generally adjacent said idle speed bypass bore.

14. An integrated throttle body assembly according to claim 13, wherein said throttle body is made of die cast metal or molded plastic.

15. An integrated throttle body assembly according to claim 13, wherein said electronic control module comprises at least one of a powertrain control module, a throttle position sensor, a throttle position sensor module, a mass air flow sensor, and a mass air flow sensor module.

16. An integrated throttle body assembly according to claim 13, wherein said throttle body is made of plastic, said assembly further comprising a thermally conductive heat sink disposed within said throttle body, said heat sink having a first end in thermal contact with said module and having a second end exposed to an interior of at least one of said N bore(s).

17. An integrated throttle body assembly according to claim 13, wherein said N bore(s) comprises at least a main bore, said assembly further comprising:

(c) a throttle plate shaft through the main bore, said shaft having a first end to which a magnet is attached; and (d) a generally semicircular array of giant magnetoresistors arranged on said electronic control module in a plane generally orthogonal to said throttle plate shaft adjacent said first end of said shaft, whereby said array of giant magnetoresistors may sense a magnetic flux plane associated with said magnet in order to determine an angular position of said throttle plate shaft.

* * * * *